United States Patent [19]

Tanabe

[11] Patent Number: 4,712,926

[45] Date of Patent: Dec. 15, 1987

[54] ELECTRONIC TIMEPIECE

[75] Inventor: Tohru Tanabe, Showa, Japan

[73] Assignee: Rhythm Watch Company Limited, Tokyo, Japan

[21] Appl. No.: 878,411

[22] Filed: Jun. 25, 1986

[30] Foreign Application Priority Data

Jun. 29, 1985 [JP] Japan ..... 60-141587
Jun. 29, 1985 [JP] Japan ..... 60-98374[U]

[51] Int. Cl.[4] ..... G04C 21/16

[52] U.S. Cl. ..... 368/251; 368/252; 368/273

[58] Field of Search ..... 368/243, 245, 244, 250, 368/251, 252, 272, 273

[56] References Cited

U.S. PATENT DOCUMENTS 4,251,877 2/1981 Scheer ..... 368/251
4,270,200 5/1981 Stechmann et al. ..... 368/250
4,290,131 9/1981 Kume et al. ..... 368/241

FOREIGN PATENT DOCUMENTS 3112680 10/1982 Fed. Rep. of Germany ..... 368/273
49976 5/1981 Japan ..... 368/251

*Primary Examiner*—Bernard Roskoski
*Attorney, Agent, or Firm*—Koda and Androlia

[57] ABSTRACT

An electronic timepiece which produces a time tone based on a time code signal from a time code disk, comprising a control circuit for generating read-in signals in response to a start signal produced on the hour, memory circuit means for storing a time code signal from said time code disk in response to said read-in signals, wherein a stored code signal of said memory circuit means is supplied to a clock strike count control circuit as a signal for limiting the number of time tone strikes. Further, first and second memory circuit means are provided for storing the time code successively, and an AM/PM discriminating circuit is also provided for discriminating AM and PM by receiving said stored time codes of said first and second memory circuit means.

9 Claims, 14 Drawing Figures

| Fig.4A | Fig.4B |
|---|---|

| Fig.10 A | Fig.10 B |
|---|---|

ELECTRONIC TIMEPIECE

BACKGROUND OF THE INVENTION

1. Field of the Invention

This invention relates to an electronic timepiece for producing a time tone on the hour, more particularly, to a timepiece which produces a time tone based on a time code signal from a time code disk rotating together with a hour hand, and to a timepiece which automatically discriminates between AM and PM.

2. Prior Art

A conventional timepiece of the former type is disclosed in the specification of Japanese Patent (second) Publication No. 56-5357. This conventional timepiece is adapted to detect a time code signal in a predetermined period of time before the hour, which signal is obtained from a time code disk operatively associated with the rotation of an hour hand shaft, and to produce a time tone comparing the time code signal with a number of clock strikes when the on-the-hour time (The term "on-the-hour time" as used in the following description and in the appended claims has the meaning of the time when the current time comes on the hour.) is attained.

In the example of the prior art mentioned above, produce of the time tone is prepared for in advance by detecting the code signal corresponding to the on-the-hour time is a predetermined period of time before the hour. Accordingly, if a monitoring operation is performed after detection of the code signal but before the on-the-hour time, the indication given by the time tone will differ from the actual time. In other words, the monitored time tone will indicate the next hour.

Further, in an electronic timepiece producing a time tone and having a night silencing circuit for inhibiting the produce of the time tone during midnight, it is necessary to discriminate between AM and PM.

A conventional timepiece of this type is disclosed in the specification of Japanese Patent Publication No. 59-195188. In this conventional timepiece, a 24-hours counter is employed for counting the present time. This timepiece discriminates AM and PM by using an output signal of the 24-hours counter.

However, when a battery is changed or when the user corrects a time, the 24-hours counter doesn't operate in accordance with movement of indicating hands. Therefore, in this prior art, it is necessary to take special operation for correspondingly setting the counter to time indicated by the indicating hands.

The present invention seeks to overcome the above-mentioned problem in the prior arts.

SUMMARY OF THE INVENTION

It is, therefore, an object of the present invention to produce a time tone indicative of the actual time under any monitoring operation.

It is the other object of the present invention to discriminate automatically between AM and PM without special operation.

In keeping with the principles of the present invention, the above-mentioned objects are accomplished by an electronic timepiece including a time tone contact for providing a start signal, a time code disk having time codes of on-the-hour times corresponding to a time indication made by time indicating hands, time tone circuit means for starting a time tone generating operation in response to said start signal, and a clock strike count control circuit which receives a code signal from said time code disk as a signal for limiting the number of time tone strikes, for terminating the time tone operation when the code value and the number of time tone strikes generated coincide, comprising: a control circuit for generating read-in signals in response to the start signal; and memory circuit means for storing a time code from said time code disk in response to said read-in signals; wherein a stored code signal from said time code memory circuit is supplied to said clock strike count control circuit as the signal for limiting the number of time tone strikes, and by an electronic timepiece including an analog display for displaying time by time indicating hands, and time tone circuit means for starting a time tone generating operation on the hour, comprising: a time code disk having time codes of on-the-hour times corresponding to said time indicating hands; a control circuit for generating first and second read-in signals; first memory circuit means responsive to said first read-in signal for storing said time code from said time code disk; second memory circuit means responsive to said second read-in signal for storing a stored time code in said first memory circuit means; and an AM/PM discriminating circuit discriminating AM and PM by receiving said stored time codes of said first and second memory circuit means.

BRIEF DESCRIPTION OF THE DRAWINGS

The above-mentioned features and objects of the present invention will become more apparent by reference to the following description taken in conjunction with the accompanying drawings in which.

DETAILED DESCRIPTION OF THE INVENTION

Figure 1:
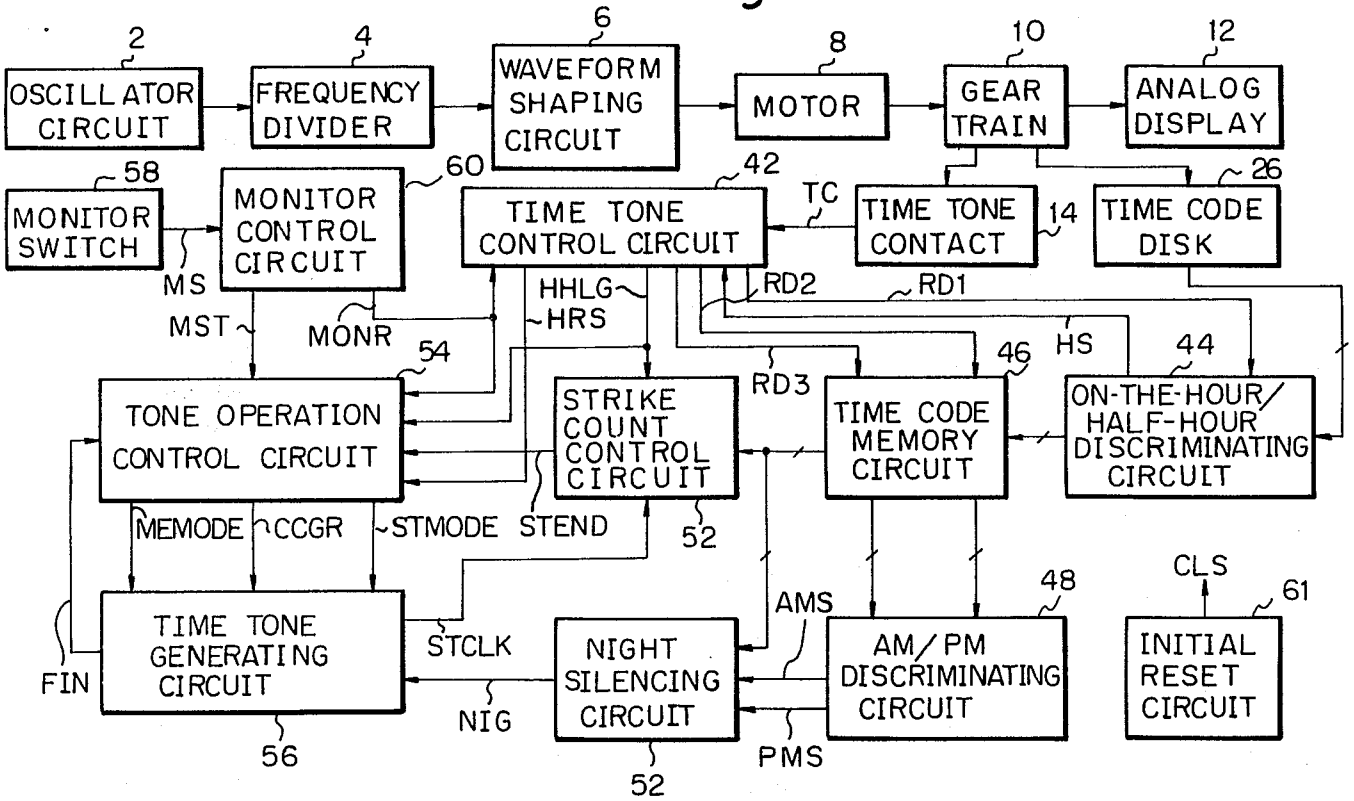
FIG. 1 is a block diagram illustrating an embodiment of the present invention.

FIG. 1 is a block diagram illustrating an embodiment of the present invention.

Numeral 2 denotes an oscillator circuit for outputting a high-frequency signal, 4 a frequency divider circuit for dividing the high-frequency signal from the oscillator circuit, 6 a waveform shaping circuit for shaping the waveform of the frequency-divided signal, 8 a motor driven by the signal from the waveform shaping circuit, 10 a gear train driven by the motor 8, and 12 an analog display driven by the gear train 10.

Figure 2:
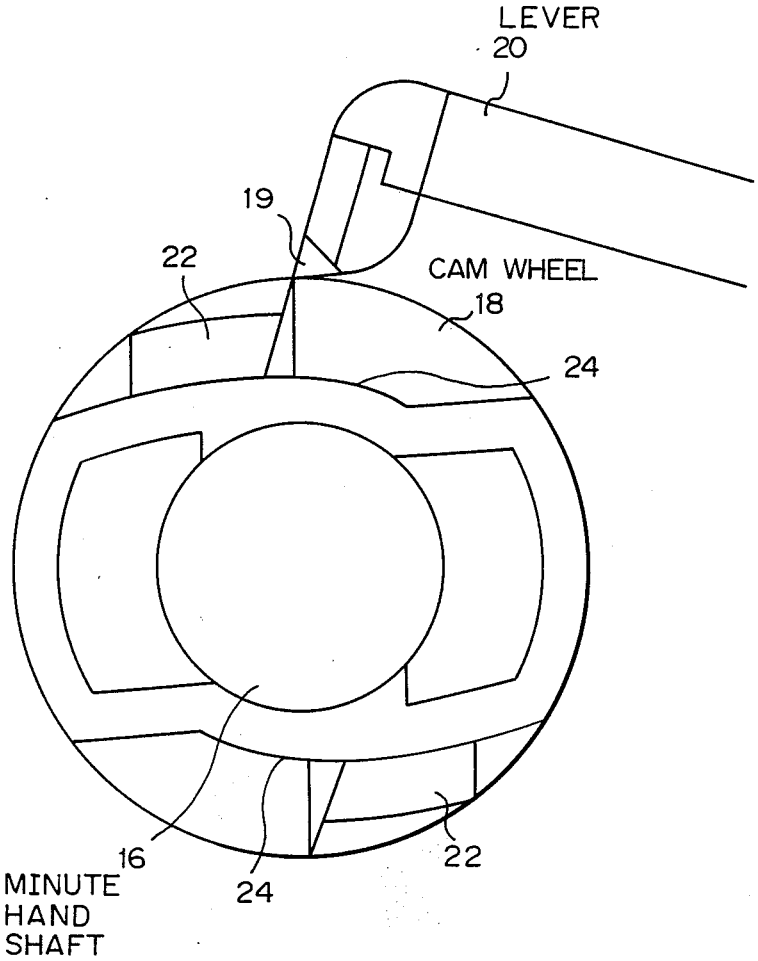
FIG. 2 is a view showing detailed structure of a time tone contact illustrated in FIG. 1.

Numeral 14 denotes a time tone contact which, as shown in FIG. 2, comprises a cam wheel 18 attached to a shaft which makes one revolution per hour to a minute hand shaft 16 in the gear train 10, and a lever 20 having an engaging element 19 at the portion thereof. The cam wheel 18 has two projections 22 on opposite sides. The time tone contact 14 outputs a signal TC on the hour and on the half hour when the engaging element 19, which is in contact with the outer periphery of the cam wheel 18, falls onto a receiving surface 24 twice per hour.

Figure 3:
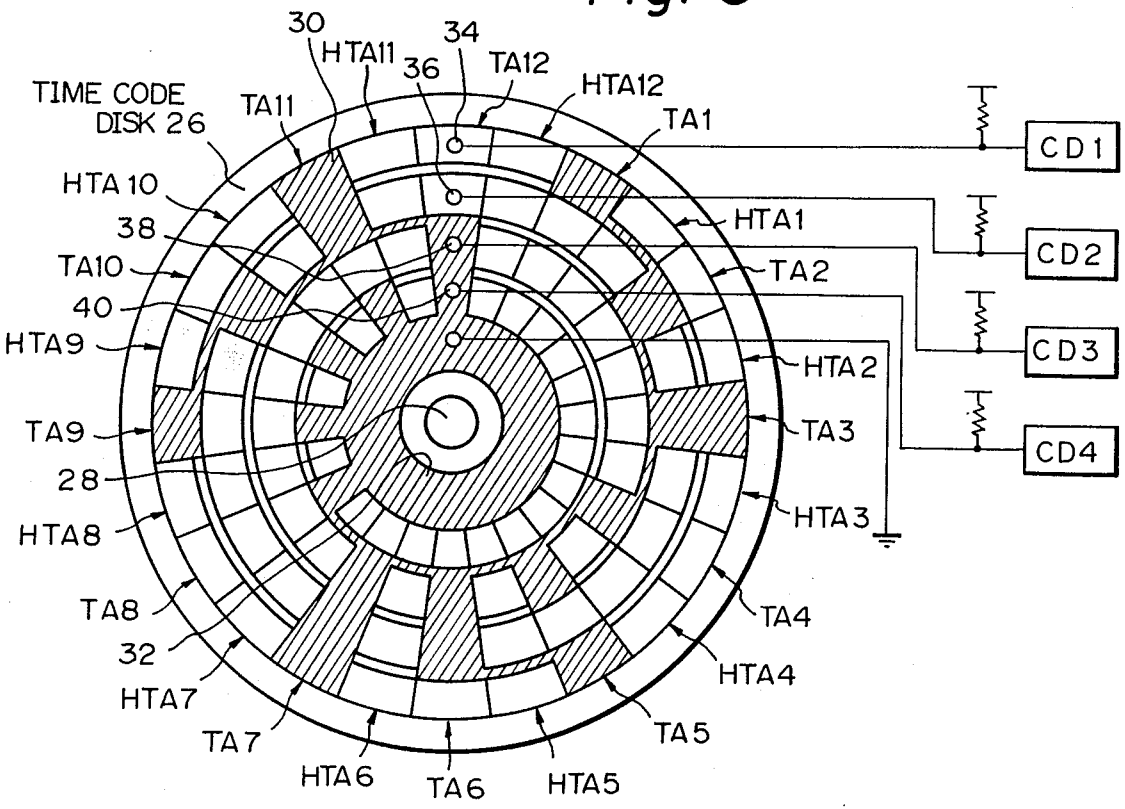
FIG. 3 is a view showing the detailed structure of a time code disk illustrated in FIG. 1.

Numeral 26 denotes a time code disk comprising a non-conductive material. As shown in FIG. 3, the disk is attached to a shaft that makes one revolution in 12 hours or to an hour hand shaft 28 in the gear train 10. The time code disk 26 has a flat surface divided into 24 radially extending areas, each of which is further divided diametrically into four areas. The radially extending areas include time areas $TA_1$–$TA_{12}$ representing the on-the-hour times, namely hour units, and half-hour time areas $HTA_1$–$HTA_{12}$ representing the on-the-half-hour times. These areas $TA_1$–$TA_{12}$ and $HTA_1$–$HTA_{12}$ are alternately arranged. Each of the time areas $TA_1$–$TA_{12}$ have electrically conductive portions 30, shown in black, in suitable ones of the diametric areas so as to represent respective time codes. The conductive portions 30 are all connected to a conductive portion 32 located near the center of the time code disk 26, and each portion 30 is also grounded. The half-hour time areas $HTA_1$–$HTA_{12}$ are not provided with conductive portions and, hence, are non-conductive. The time code disk 26 is contacted by contacts 34–40 corresponding to the diametrically divided areas in the radially extending areas. Each of these contacts produces an H-level output when touching a non-conductive portion of the disk and an L-level output when touching a conductive portion of the disk. Output signals $CD_1$–$CD_4$ provided from these contacts will all be at the high level on the half hour. It should be noted that the levels of these time code signals $CD_1$–$CD_4$ from the time code disk 26 are changed over and outputted before the on-the-hour and on-the-half-hour times are actually attained.

Numeral 42 denotes a time tone control circuit for outputting a variety of control signals upon receiving such signals as the signal TC from the time tone contact 14. Numeral 44 denotes an on-the-hour/half-hour discriminating circuit providing an on-the-hour/half-hour discrimination signal HS upon receiving the code signals from the time code disk 26 in response to a signal $RD_1$ from the time tone control circuit 42.

Numeral 46 designates a time code memory circuit for storing the time codes. Specifically, the memory circuit 46 stores a time code signal supplied by the on-the-hour/half-hour discriminating circuit 44 in response to first and second read-in signals $RD_2$, $RD_3$ from the time tone control circuit 42.

Numeral 48 denotes an AM/PM discriminating circuit for differentiating between AM and PM based on a change from the preceding time code to the present time code, which are stored in the time code memory circuit 46.

Numeral 50 denotes a strike count control circuit for outputting a pulse signal STEND which terminates clock strikes in accordance with the time code stored in the time code memory circuit 46, and for designating a number of clock strikes in a time tone produced on the half-hour in dependence upon a signal HHLG from the time tone control circuit 42.

Numeral 52 represents a night silencing circuit which receives signals from the time code memory circuit 46 and AM/PM discriminating circuit 48 for silencing time tone when a predetermined time is attained and for reactivating the silenced time tone when another predetermined time is attained.

Numeral 54 denotes a tone operation control circuit for starting a tone operation in response to a signal HRS provided from the time tone control circuit 42, and for inhibiting generation of a melody on the half-hour in response to the signal HHLG. The tone operation control circuit 54 outputs a signal MEMODE indicating melody operation start, and a signal STMODE indicating clock strike operation start.

Numeral 56 represents a time tone producing circuit for producing a time tone corresponding to the signal MEMODE, STMODE from the tone operation control circuit 54. At night, the time tone producing circuit 56 stops generation of the time tone in response to a signal NIG from the night silencing circuit 52.

Numeral 58 denotes a monitor switch, and numeral 60 designates a monitor control circuit which, in response to operation of the monitor switch 58, applies a monitor start signal MST to the tone operation control circuit 54 to initiate a monitoring operation.

Numeral 61 designates an initial reset circuit for initially resetting various circuits as when power is introduced from a battery.

The construction and operation of the circuits shown in FIG. 1 will now be described with reference to detailed circuit diagrams thereof.

Figures 4, 4A:
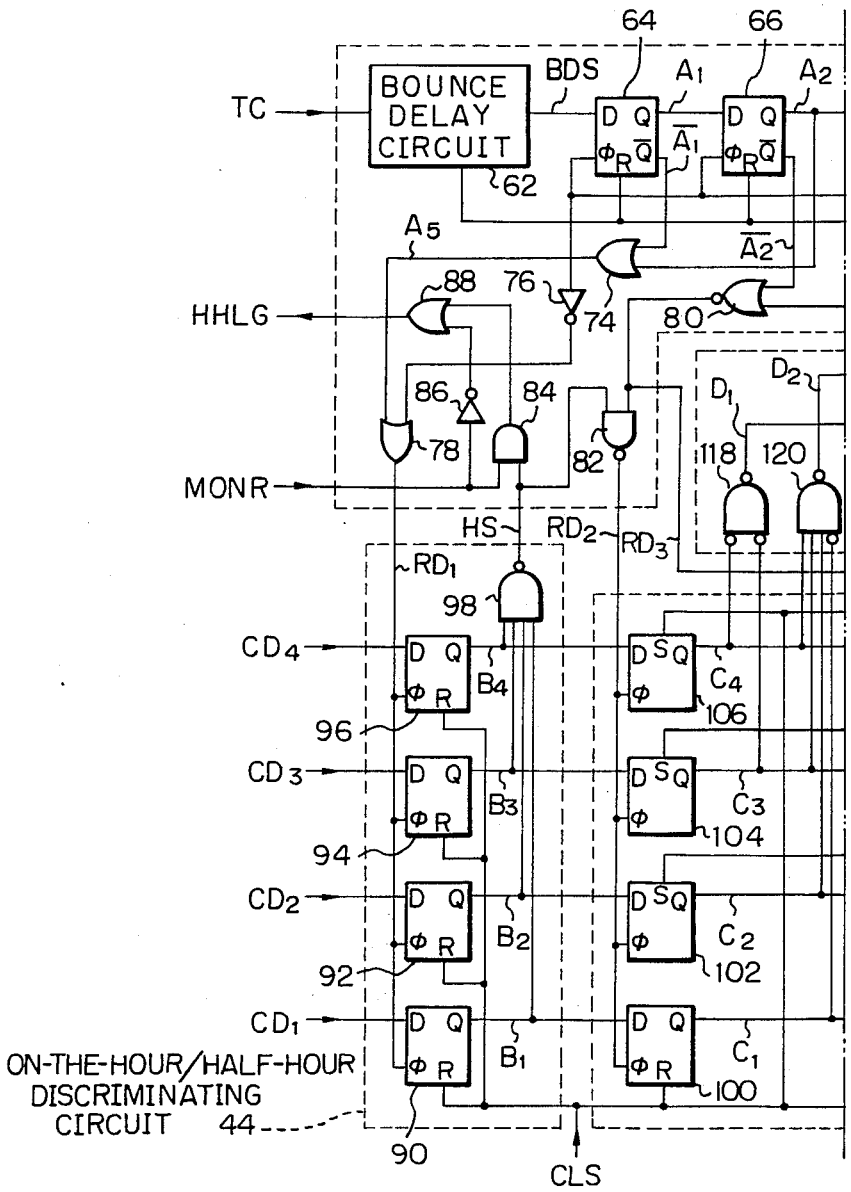
FIGS. 4A, 4B is a circuit diagram showing the detailed structure of a time tone control circuit, an on-the-hour/half-hour discriminating circuit, a time code memory circuit, an AM/PM discriminating circuit and a night silencing circuit illustrated in FIG. 1.
Figure 4B:
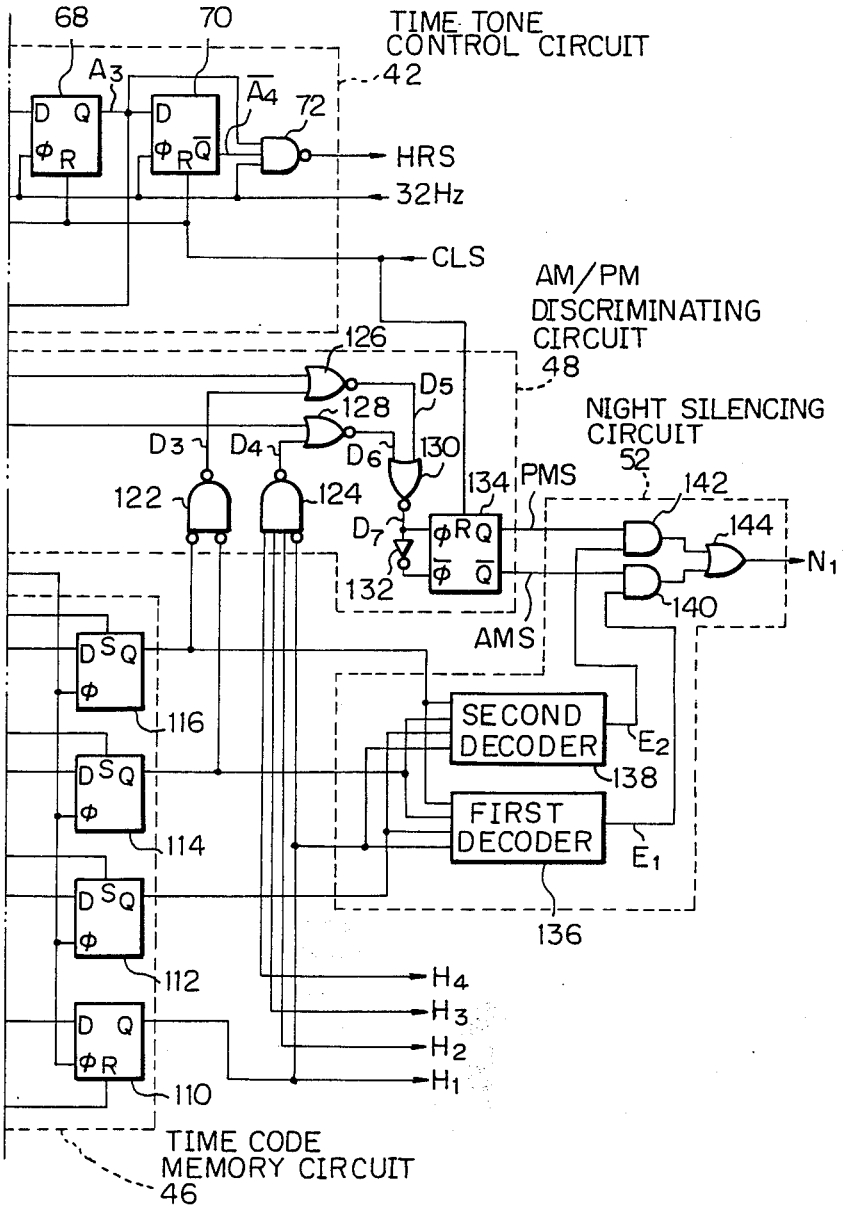

FIG. 4 is a circuit diagram illustrating the time tone control circuit 42, on-the-hour/half-hour discriminating circuit 44, time code memory circuit 46, AM/PM discriminating circuit 48 and night silencing circuit 52, which are shown in FIG. 1.

The time tone control circuit 42 comprises a bounce delay circuit 62 which delays the signal TC from the time tone contact 14 for a prescribed period of time to prevent chattering; flip-flops 64–70 connected cascade from the output terminal Q of one to the input terminal D of the next, each fllip-flop having a 32 Hz signal applied to its clock input $\phi$; a NAND gate 72 receiving output signals $A_3$, $A_4$ from the flip-flops 68, 70 and the 32 Hz signal for providing the HRS which starts the time tone operation; an OR gate 74 receiving output signals $\overline{A_1}$, $A_2$ from the flip-flops 64, 66; an OR gate 78 receiving an output signal $A_5$ of the OR gate 74 and the 32 Hz signal which has been inverted by an inverter 76 for outputting the signal $RD_1$; a Nor gate 80 receiving output signals $\overline{A_2}$, $A_3$ from the flip-flops 66, 68 applied thereto; a NAND gate 82 receiving the signal HS from the on-the-half-hour discriminating circuit 44 and the signal $RD_3$ from the NOR gate 80; an AND gate 84 receiving the signal HS and a signal MONR from the monitor control circuit 60; an OR gate 88 receiving the output signal of the AND gate 84 and the signal MONR which has been inverted by an inverter 86.

The on-the-hour/half hour discriminating circuit 44 comprises flip-flops 90–96 having input terminals D which receive the code signals $CD_1$–$CD_4$, respectively, from the time code disk 26 shown in FIG. 3, and clock inputs $\phi$ each of which receives the signal $RD_1$ from the time tone control circuit 42, and a NAND gate 98 receiving output signals $B_1$–$B_4$ from these flip-flops for outputting the on-the-hour/half-hour discrimination signal HS.

The time code memory circuit 46 comprises flip-flops 100–106 each having a clock input $\phi$ which receives a first read-in signal $RD_2$ from the time tone control circuit 42, and flip-flops 110–116 having input terminals D which receive output signals $C_1$–$C_4$, respectively, from the flip-flops 100–106, and clock inputs $\phi$ each of which receives a second read-in signal $RD_3$ from the time tone control circuit 42.

The AM/PM discriminating circuit 48 comprises a NAND gate 118 which receives the inverted output signals $C_3$, $C_4$ of the time code memory circuit 46; a NAND gate 120 which receives the inverted signal $C_1$ and the signals $C_2$, $C_3$, $C_4$; a NAND gate 122 which receives inverted signals $H_2$, $H_4$; a NAND gate 124 which receives inverted signal $H_1$ and signals $H_2$, $H_3$, $H_4$; a NOR gate 126 to which signals $D_2$, $D_3$ are applied; a NOR gate 128 to which signals $D_1$, $D_4$ are applied; a NOR gate 130 to which output signals $D_5$, $D_6$ from the NOR gates 126, 128 are applied; and a flip-flop 134 having a clock input $\phi$ to which an output signal $D_7$ from the NOR gate 130 is applied, and a clock input $\bar{\phi}$ which the signal $D_7$ is applied after being inverted by an inverter 132.

The night silencing circuit 52 comoprises first and second decoders 136, 138, respectively, each of which receives the output signals $H_1$–$H_4$ of the time code memory circuit 46, the first decoder 136 detecting 1:00 to 5:00 and the second decoder 138 detecting 11:00 and 12:00; AND gates 140, 142 which receive output signals $E_1$, $E_2$, respectively, from the first and second decoders 136, 138 at one input terminal, and which receive output signals AMS, PMS, respectively, from the AM/PM discriminating circuit 48 at a second input terminal; and an OR gate 144 which receives output signals from the AND gates 140, 142 for outputting the night silencing signal NIG.

Figure 6:
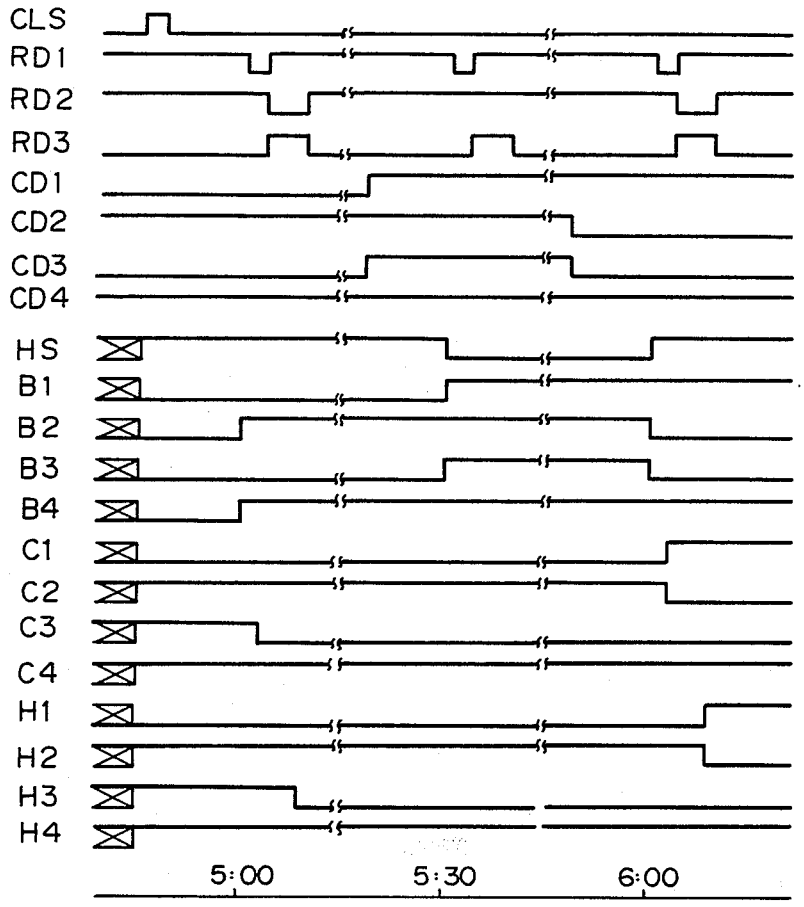
Figure 7:
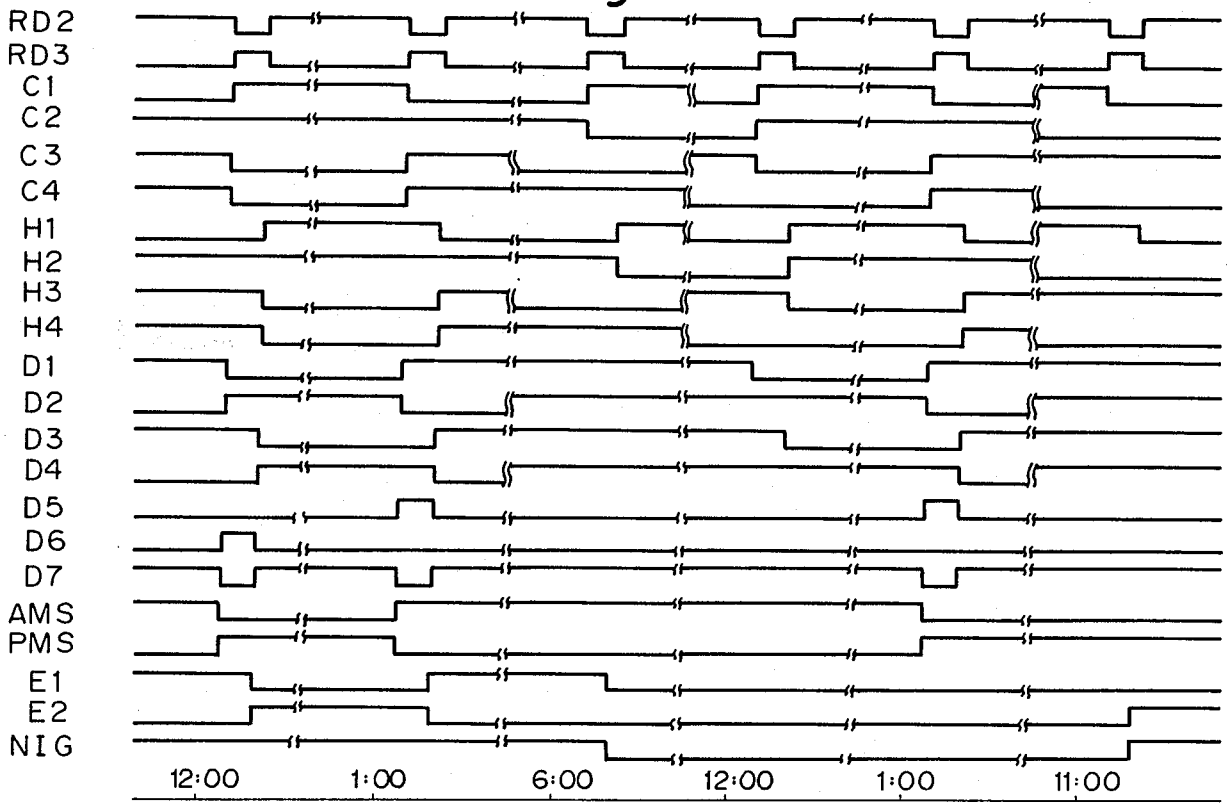

The operation of each of the circuits constructed as set forth above will now be described based on the timing charts shown in FIGS. 5 through 7.

Figure 5:
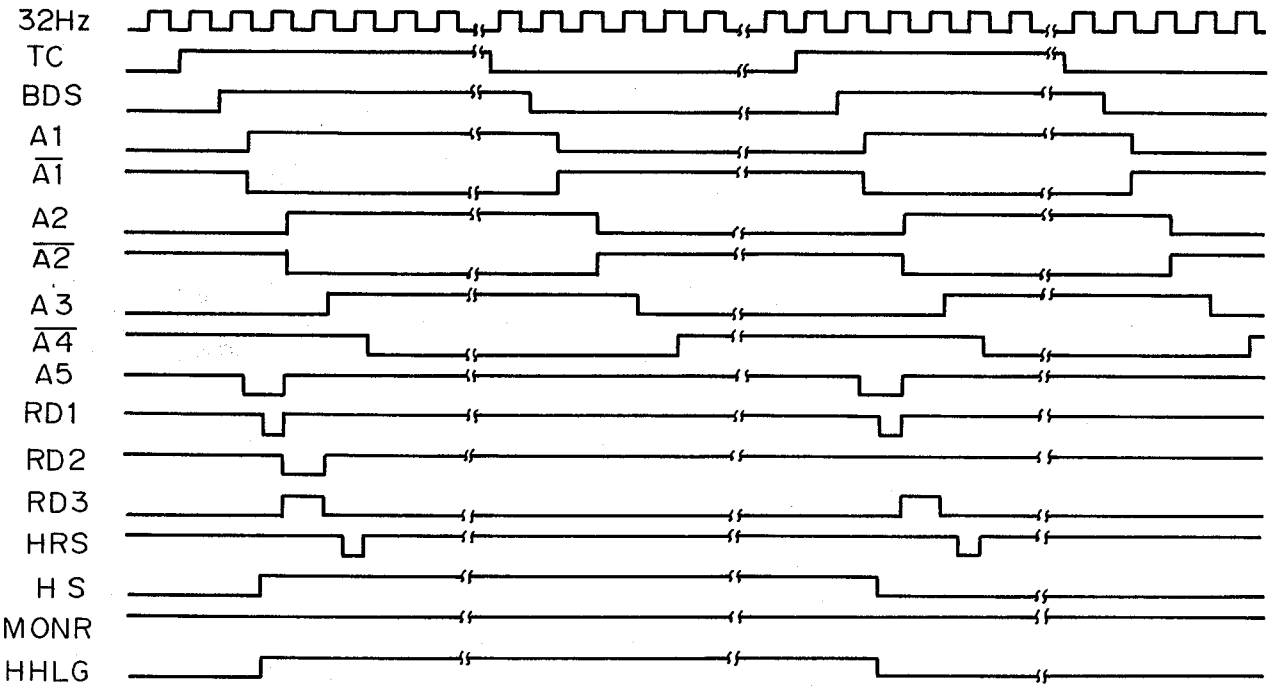
FIGS. 5 through 7 are timing charts associated with FIG. 4.

First, let us describe the operation of the time tone control circuit 42 with reference to the timing chart of FIG. 5.

When the time tone contact 14 attains the ON state, the signal TC rises to the H level, as shown in FIG. 5. The signal TC is delayed for a prescribed period of time by the bounce delay circuit 62, which delivers the signal as a signal BDS. When the signal BDS attains the H level, the output signal A, of the fllip-flop 64, which has been present by a signal CLS from the initial reset circuit 61, is changed over to the H level in synchronism with negative-going transition of the 32 Hz signal. The outputs $A_2$, $A_3$, $\overline{A_5}$of the flip-flops 66, 68, 70 successively change over to the H, H, L levels, respectively.

Consequently, the output signal $A_5$ of the OR gate 74 to which the signals $\overline{A_1}$, $A_2$are applied becomes the L level for only one cycle of the 32 Hz signal. Further, the output signal $RD_1$ of the OR gate 78, which receives the signal $A_5$ and the inverted 32 Hz signal, becomes the L level for a duration equivalent to only one pulse of the 32 Hz signal. The output signal $RD_3$ of the NOR gate 80, which receives the signals $\overline{A_2}$, $A_3$, becomes the H level for only one cycle of the 32 Hz signal at the moment the signal $RD_1$ attains the H level. If the output signal HS of the on-the-hour/half-hour discriminating circuit 44 is at the H level, the output signal $RD_2$ of the NAND gate 82 will be a signal which is the inverse of the signal $RD_3$.

The output signal HRS of the NAND gate 72 falls to the L level if the signals $A_3$, $\overline{A_4}$ and the 32 Hz signal applied thereto all attain the H level, and rises to the H level when the output of the flip-flop 70 changes state. In response to this change of the signal HRS, the tone operation control circuit 54 (shown in FIG. 8) begins operating.

When the signal HS attains the H level to indicate that an on-the-hour time has been attained, the output of the AND gate 84 also attains the H level, so that the output signal HHLG of the OR gate 88 likewise attains the H level, thereby making the tone operation control circuit 54 produce a melody. In a case where the time is on the half hour, the on-the hour/half-hour discriminating circuit 44 discriminates the on-the-half-hour time and places the signal HS at the L level when the signal $RD_1$ becomes the L level. As a result, the output signal $RD_2$ of NAND gate 82 is held at the H level, thereby preventing the time from being read in the time code memory circuit 46.

Thus, when the signal TC rises to the H level, the time tone control circuit 42 successively outputs the signal $RD_1$ for starting the on-the-hour/half-hour discrimination, the first read-in signal $RD_2$ for allowing the present time to be read in the time code memory circuit 46, the second read-in signal $RD_3$ for updating the stored time in the time code memory circuit 46, and the signal HRS for starting the tone generating operation.

The operation of the on-the-hour/half-hour discriminating circuit 44 and time code memory circuit 46 will now be described with reference to the timing chart of FIG. 6.

The on-the-hour/half-hour discriminating circuit 44 and time code memory circuit 46 are set to their initial states by the signal CLS from the initial reset circuit 61. More specifically, the flip-flops 90–96 of the on-the-hour/half-hour discriminating circuit 44 are reset, the flip-flops 100, 110 of the time code memory circuit 46 are reset, and the flip-flops 102–106 of the latter circuit are set, whereby the circuits 44, 46 are set to the 1:00 state. Thereafter, when the time has been corrected and the time tone contact 14 (FIG. 1) attains the ON state on the hour, the output signal $RD_1$ of the time tone control circuit 42 falls to the L level.

In synchronism with the negative-going transition of the signal $RD_1$, the flip-flops 90–96 in the on-the-hour/-half-hour discriminating circuit 44 change state, depending upon the states of the signals $CD_1$–$CD_4$ applied thereto. For example, if the present time is 5:00, the signals $CD_1$–$CD_4$ from the time code disk 26 (FIG. 3) are at levels L, H, L, H, respectively, as a result of which the output signals $B_1$–$B_4$ of the flip-flops 90–96 also attain the levels L, H, L, H, respectively. If any one of the signals $B_1$–$B_4$ is at the L level, the output signal HS of the NAND gate 98 attains the H level, as a result of which it is determined that the present time is an on-the-hour time.

As time passes and the time becomes 5:30, all the signals $CD_1$–$CD_4$ from the time code disk 26 become the H level, as mentioned above. When the signal $RD_1$ falls to the L level, the output signals $B_1$–$B_4$ of the flip-flops 90–96 also all attain the H level. Consequently, the output signal HS from the NAND gate 98 falls to the L level, as a result of which it is determined that the present time is an on-the-half-hour time.

When an on-the-hour time is attained, the outputs of the flip-flops 100–106 in the time code memory circuit 64 changeover, depending upon the signals $B_1$–$B_4$ from the on-the-hour/half-hour discriminating circuit 44, for storing the time code in synchronism with the negative-going transition of the first read-in signal $RD_2$ from the time tone control circuit 42. In the case shown in FIG. 6, only the output signal $C_3$ of flip-flop 104 changes over to the L level. Next, when the second read-in signal $RD_3$ becomes the L level, the output states of flip-flops 110–116 changeover in dependence upon the output signals $C_1$–$C_4$ from the flip-flops 100–106 for storing the time code which have been stored in the flip-flops 100–106. The reason for providing the flip-flops 100–106 and 110–116 and providing the time lag between time code read-in timings thereof is to arrange it so that the AM/PM discriminating circuit 48 discriminates AM/PM based on the present and preceding times stored by the time code memory circuit 46.

Thereafter, when the time becomes an on-the-half-hour time, the output signals $B_1$–$B_4$ of the on-the-hour/-half-hour discriminating circuit 44 all attain the H level, as mentioned above. At this time, the first read-in signal $RD_2$ of the time tone control circuit 42 is held at the H level, so that the output states of flip-flops 100–106, 110–116 cannot change.

When the time becomes on the hour again, the output signal HS of the on-the-hour/half-hour discriminating circuit 44 rises to the H level, and the signal $RD_2$ outputted by the time tone control circuit 42 falls to the L level. Therefore, the output states of flip-flops 100–106 changeover in dependence upon the states of the signals $B_1$–$B_4$ applied thereto. Then, when the signal $RD_3$ falls to the L level, the output states of flip-flops 110–116 also change in dependence upon the states of the signals $C_1$–$C_4$.

Thus, whenever the time becomes on the hour and on the half hour, the on-the-hour/half-hour discriminating circuit 44 discriminates the fact and changes the state of the discrimination signal HS. The time code memory circuit 46 reads in and stores the code signal indicative of the present time in synchronism with the negative-going transitions of the first and second read-in signals $RD_2$, $RD_3$.

Described next will be the operation of the AM/PM discriminating circuit 48 and night silencing circuit 52 with reference to the timing chart shown in FIG. 7.

As described above, the NAND gates 118–124 of the AM/PM discriminating circuit 48 receives predetermined signals from the time code memory circuit 46. When the time code stored in flip-flops 100–106, 110–116 become in the state indicating 12:00, the output signals $D_1$, $D_3$ of the NAND gates 118, 122 assume the L level. When the time code stored in the flip-flops 100–106, 110–116 become in the state indicating 1:00, the output signals $D_2$, $D_4$ of the NAND gates 120, 124 assume the L level. Accordingly, when the time code memory circuit 46 is initially set to 1:00 by the initial reset circuit 61, as mentioned above, the signals $D_2$, $D_4$ from the NAND gates 120, 124 fall to the L level. At this time, the flip-flop 134 is also initially reset, and the AM signal AMS attains the H level. In the initial state, 1:00 AM is set.

If the analog display 12 (FIG. 1) is turned backwards and set to e.g. 12:00 in the initial state, the output signals $C_1$–$C_4$ from the fliop-flops 100–106 assume a state indicating 12:00 in synchronism with the negative-going transition of the first read-in signal $RD_2$, as mentioned above. In consequence, the signal $D_2$ attains the H level and the signal $D_1$ falls to the L level.

Since the output signals $H_1$–$H_4$ of the time code memory circuit 46 are still in a state indicating 1:00 at this time, the signal $D_4$ is held at the L level. As a result, the output signal $D_3$ of the NOR gate 128, whose inputs are the signals $D_1$, $D_4$, rises to the H level. When the output signals $H_1$–$H_4$ of the flip-flops 110–116 attain a state indicative of 1:00 in response to the negative-going transition of the second read-in signal $RD_3$, the signal $D_4$ attains the H level and, hence, the signal $D_6$ falls to the L level.

Thus, when the time changes from 1:00 to 12:00, a pulse appears in the signal $D_6$ and an output signal $D_7$ from the NOR gate 130 falls to the L level at the same time that this pulse rises. The output state of the flip-flop 134 changes in synchronism with the negative-going transition of the signal $D_7$, and the signals AMS, PMS assume the L and H level, respectively.

When the time later becomes 1:00 AM, the output signals $C_1$–$C_4$ of the flip-flops 100–106 change over to states indicative of 1:00 in synchronism with the negative-going transition of the first read-in signal $RD_2$, the output signal $D_2$ of NOR gate 120 again reverts to the L level, and the signal $D_1$ attains the H level. Since the output signals $H_2$–$H_4$ of the flip-flops 110–116 at this time are still at states indicative of 12:00, the second read-in signal $D_3$ of NOR gate 122 is held at the L level until this condition is changed over by the signal $RD_3$. In consequence, now a pulse appears in the output signal $D_5$ of the NOR gate 126, the output signal $D_7$ of the NOR gate 130 falls to the L level at the same time that this pulse rises, and the output state of flip-flop 134 changes over again in synchronism with the negative-going transition of the signal $D_7$.

Thus, the AM/PM discriminating circuit 48 receives code signals indicative of the present and preceding times stored by the flip-flops 100–106, 110–116 of the time code memory circuit 46 and changes over between AM and PM when the time changes from 12:00 to 1:00 or from 1:00 to 12:00.

When the first decoder 136 of the night silencing circuit 52 detects "1"–"5" indicated by the time code signals $H_1$–$H_4$, the signal $E_2$ is set to the H level. When the second decoder 138 of the night silencing circuit detects "11", "12" indicated by the time code signals $H_2$–$H_4$, the signal $E_4$ in set to the H level. The AND gates 140, 142 of the night silencing circuit 52 respectively receive the signals AMS, PMS, in response to which AND gate 140 is placed in the open state during the AM hours and AND gate 142 is placed in the open state during the PM hours. Accordingly, when the signals $E_1$, $E_2$ are respectively applied to the AND gates 140, 142, the output of AND gate 140 is at the H level from 1:00 AM to 6:00 PM, and the output of AND gate 142 is at the H level from 11:00 PM to 1:00 AM. As a result, the output signal NIG of the OR gate 144 is at the H level from 11:00 PM to 6:00 AM.

Figure 8:
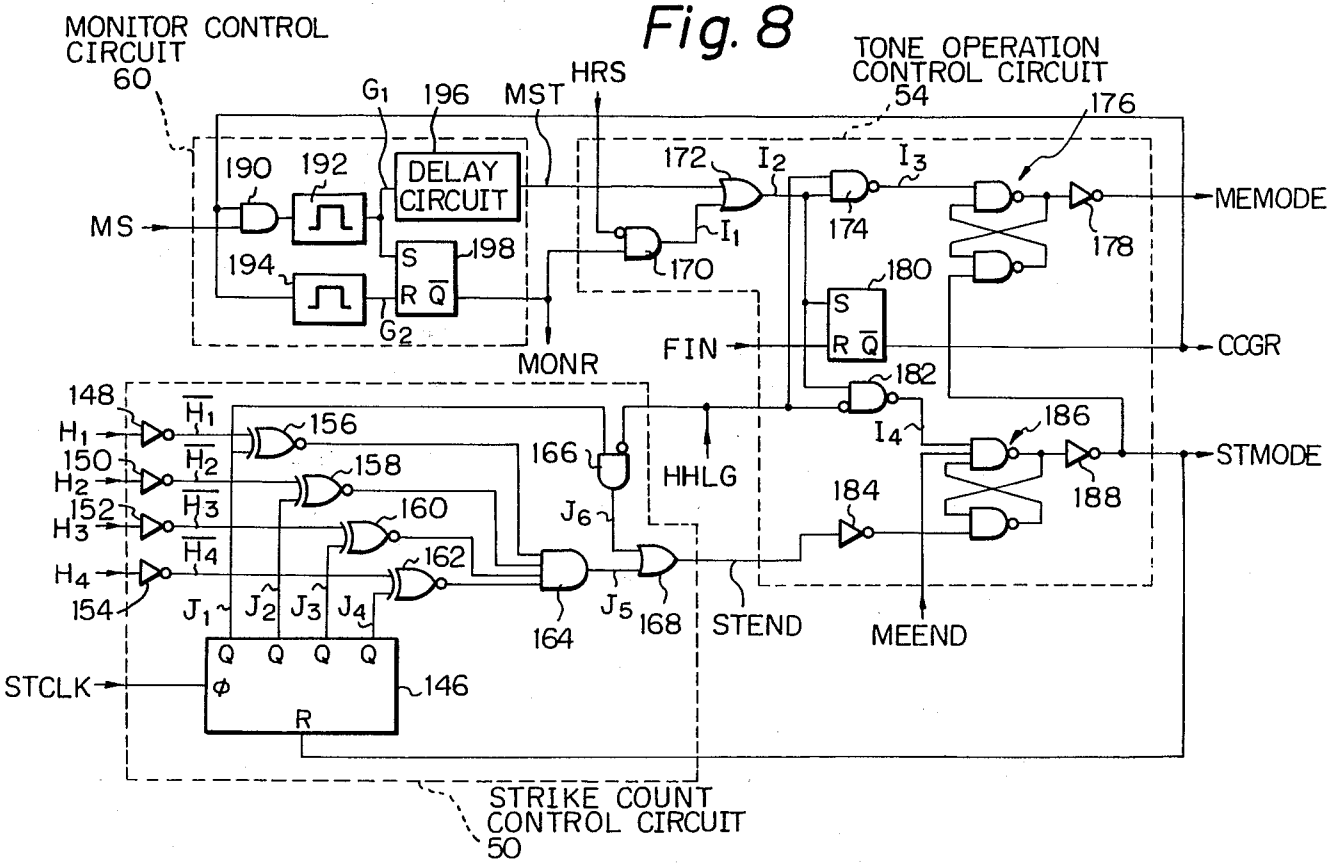
FIG. 8 is a circuit diagram showing the detailed structure of a strike count control circuit, a tone operation control circuit and a monitor control circuit illustrated in FIG. 1.

FIG. 8 is a detailed circuit diagram of the strike count control circuit 50, tone operation control circuit 54 and monitor control circuit 60 illustrated in FIG. 1.

The strike count control circuit 50 comprises a counter 146 which receives a clock strike timing signal STCLK for counting the number of clock strikes; exclusive-NOR gates 156–162 which respectively receive at one input terminal output signals $J_1$–$J_4$ from the counter 146, and which respectively receive at a second input terminal signals $\overline{H_1}$–$\overline{H_4}$, which are the outputs of the time code memory circuit 46 after having been inverted by respective inverters 148–154; an AND gate 164 to which the outputs from all of the exclusive-NOR gates are applied; an AND gate 166 which receives the output signal $J_1$ of the counter 146 and inversely receives the signal HHLG from the time tone control circuit 42; and an OR gate 168 which receives the output signals $J_5$, $J_6$ from the AND gates 164, 166 for outputting a signal STEND indicating the end of the clock strikes.

The tone operation control circuit 54 comprises an AND gate 170 which receives the signal MONR from the monitor control circuit 60 and inversely receives the signal HRS from the time control circuit 42; an OR gate 172 which receives an output signal $I_1$ from the AND gate 170 and a signal MST from the monitor control circuit 60; a NAND gate 174 which receives an output signal $I_2$ from the OR gate 172 and the signal HHLG from the time tone control circuit 42; a flip-flop 176 to which an output signal $I_3$ from the NAND gate 174 and the signal STMODE are applied; an inverter 178 for inverting the output of the flip-flop 176; a flip-flop 180 having a set input S which receives the signal $I_2$ and a reset input which receives the signal FIN, the flip-flop producing the signal CCGR; a NAND gate 182 which receives the signal $I_2$ and the signal HHLG which has been inverted; a flip-flop 186 which receives an output signal $I_4$ from the NAND gate 182, the melody and signal MEEND, and the signal STEND which has been inverted by an inverter 184; and an inverter 188 for inverting the output signal from the flip-flop 186.

The monitor control circuit 60 comprises an AND gate 190 which receives the signal MS from the monitor switch 58 and the signal CCGR from the tone operation control circuit 54; one-shot multivibrators 192, 194 which respectively receive the output signal of the AND gate 190 and the signal CCGR; a delay circuit 196 to which an output signal $G_1$ from the multivibrator 192 is applied; and a flip-flop 198 having a set input S which receives the signal $G_2$, and a reset input R which receives an output signal $R_2$ from the multiviblator 194.

Figure 9:
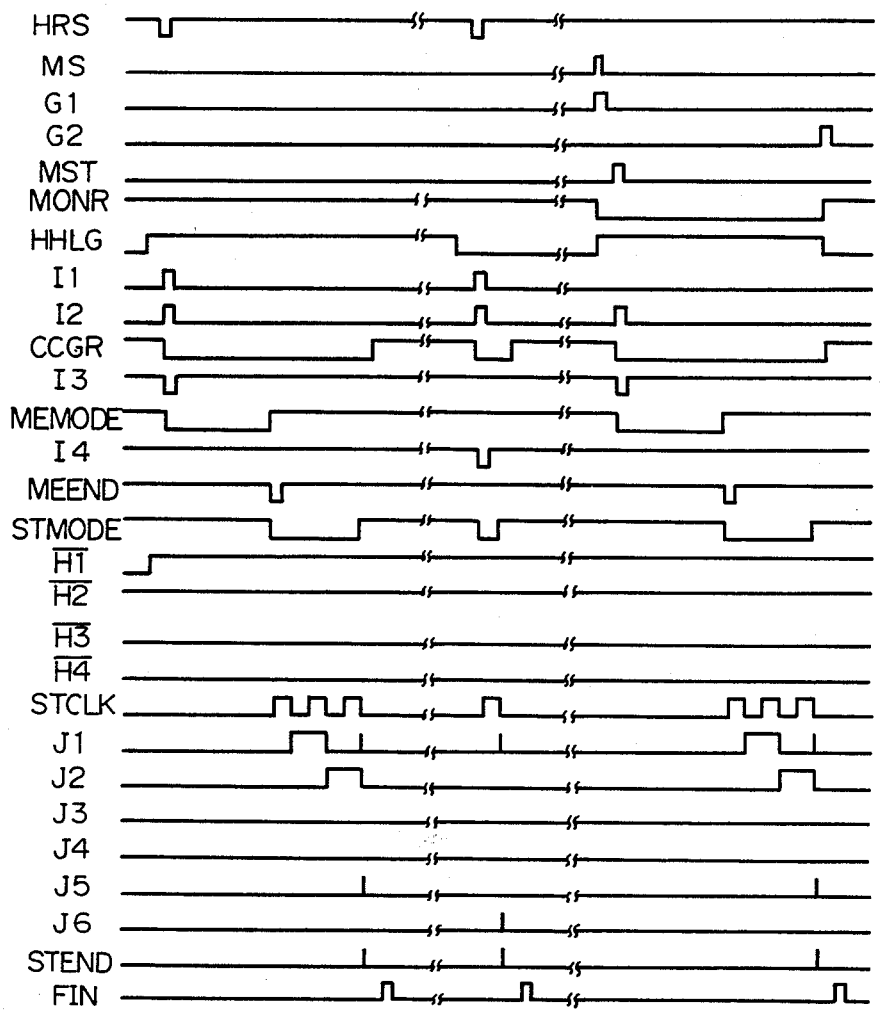
FIG. 9 is a timing chart associated with FIG. 8.

The operation of these circuits having the foregoing construction will now be described with reference to the timing chart of FIG. 9.

When a tone starts to be produced on the hour, the output signal HRS of the time tone control circuit 42 falls to the L level for a prescribed period of time and a pulse is produced in the output signal $I_1$ of AND gate 170 in the tone operation control circuit 54. The pulse produced in signal $I_1$ appears in the signal $T_2$ through the OR gate 172. In response to this pulse produced in the signal $I_2$, the flip-flop 180 is set and its output signal CCGR falls to the L level, thus establishing the tone operation state.

When the signal $I_2$ rises to the H level, the output signal $I_3$ of the NAND gate 174 falls to the L level and the output state of flip-flop 176 changes over in synchronism with the negative-going trnsition of this signal, whereby the signal MEMODE becomes the L level. When this occurs, the melody generating state is established and a predetermined melody is produced.

When the melody ends, the melody end signal MEEND outputted by the tone generating circuit 56 falls to the L level. Now the output state of flip-flop 186 changes over and the signal STMODE falls to the L level. In response to the signal STMODE, the flip-flop 176 changes the output signal MEMODE to the H level, thereby establishing the clock strike tone generating state. When the signal STMODE falls to the L level, the counter 146 in strike control circuit 50 is released from the reset state and counts the number of pulses produced in the signal STCLK. For example, when the time is 3:00, the counter 146 counts "3", whereupon the output signal $J_s$ of AND gate 184 attains the H level. Therefore, the time tone end signal STEND provided from the OR gate 168 becomes the H level, too. In response to this signal STEND, the flip-flop 186 changes state and the signal STMODE again rises to the H level, thereby resetting the counter 146. Thereafter, the flip-flop 180 is reset by the signal FIN from tone generating circuit 56, thereby ending the clock strikes.

When an on-the-half-hour time is reached, the signal HHLG from the time tone control circuit 42 falls to the L level, so that the signal $I_3$ is held at the H level even if a pulse is generated in the signal $I_2$. As a result, the signal MEMODE also is held at the H level, so that the melody tone cannot be produced. However, the output signal $I_4$ of NAND gate 182 falls to the L level at the same time that the signal $I_2$ rises. The flip-flop 186 changes state in synchronism with the negative-going transition of the signal $I_4$, thereby sending the signal STMODE to the L level to establish the clock strike tone generating state.

The counter 146 begins operating again. However, at this time the AND gate 166 is open. Accordingly, when the counter 146 counts "1", the output signal $J_6$ attains the H level and enters the OR gate 168, the output signal STEND whereof also attains the H level. As aresult, the flip-flop 186 changes state so that the on-the-half-hour time tone ends with the generation of a tone of only a single strike.

When the monitor switch 58 is operated to produce a pulse in the signal MS, a pulse MS, a pulse is produced in the output of the AND gate 190, which is in the open state at all times except when a time tone is generated, thus causing the one-shot multivibrator 192 to produce a pulse.

In response to this pulse produced in the signal $G_1$, the flip-flop 198 is placed in the set state and the signal MONR falls to the L level, thereby establishing the monitoring state. The pulse produced in the signal $G_1$ later appears in the output signal MET of the delay circuit 19C and also in the output signal $I_2$ through the OR gate 172. Thereafter, through the operation described above, the melody tone and the clock strike tones are generated. Further, the flip-flop 180 is reset by the signal FIN and its output signal CCGR attains the H level, whereupon the one-shot multivibrator 194 outputs a pulse to reset the flip-flop 198, thereby cancelling the monitoring state.

In the illustrated embodiment, the states of the signals $H_1$–$H_4$ from the code memory circuit 46 do not change until the time becomes on the hour, even if the output signals from the time code disk 26 are already indicating the next moment in time. Thereafter, even if the monitoring operation is performed during this period, said next of time will not be indicated by a time tone.

Figures 10, 10A:
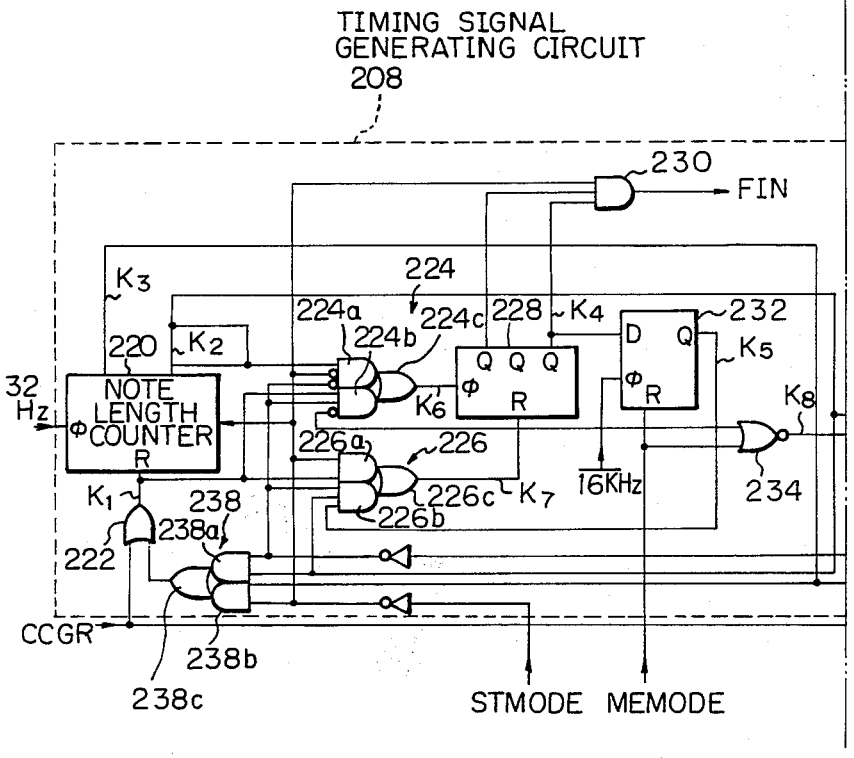
FIGS. 10, 10B is a circuit diagram showing the detailed structure of a time tone generating circuit illustrated in FIG. 1.
Figure 10B:
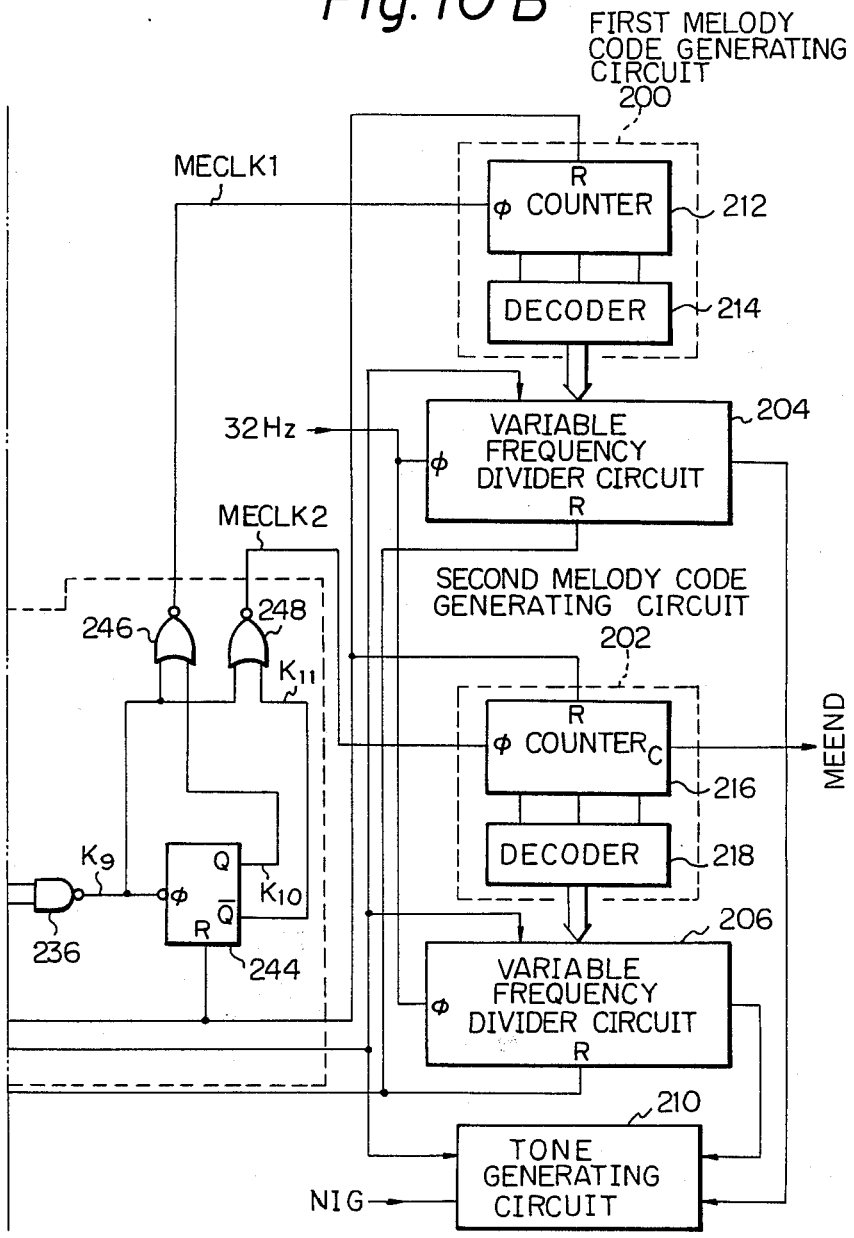

FIG. 10 is a detailed circuit diagram of the time tone generating circuit 56 shown in FIG. 1.

The time tone generating circuit 56 includes a first melody code generating circuit 200 having a counter 212 and decoder 214, a second melody code generating circuit 202 having a counter 216 and decoder 218, variable frequency divider circuits 204, 206, a timing signal generating circuit 208, and a tone generating circuit 210.

The timing signal generating circuit 208 comprises a note length counter 220 having a clock terminal $\phi$ receiving a 32 Hz signal and supplying signal $K_2$, $K_3$, respectively, in response to the state of the signal STMODE; an OR gate 222 receiving the signal CCGR and an output signal from a gate circuit 238 described below and applying a signal $K_1$ to a reset terminal R of the not length counter 220; a gate circuit 224 including an AND gate **224*a* which receives the signals $K_2$, STMODE, MEMODE, an AND gate 224*b* which receives the signal $K_1$, inverted signal MEMODE, inverted output signal $K_2$ from a flip-flop 232 described below, and an OR gate 224*c* coupled to receive the output signals from the AND gate 224*a*and 224*b* and supplying a signal $K_2$; a gate circuit 226 including an AND gate 226*a* which receives the signal $K_1$, inverted signal STMODE, an AND gate 226*b* which receives the signals $K_2$, $K_5$, inverted signal MEMODE, and an OR gate coupled to receive the output signals from the AND gates 226*a*, 226*b* and supplying a signal $K_7$; a counter 228 having a clock terminal $\phi$ receiving the signal $K_6$ and a reset terminal R receiving the signal $K_7$; and AND gate 230 receiving the inverted signal STMODE and output signals of the counter 228 for providing a signal FIN; a flip-flop 232 having a data terminal D, a sleek terminal $\phi$ and a reset terminal R which receive signals $K_4$, 16K Hz and MEMODE, respectively; a NOR gate 234 receiving a signal $K_5$ from the flip-flop 232 and the signal MEMODE for providing a signal $K_5$; a NAND gate 236 receiving signals $K_2$ and $K_9$ for providing a signal $K_9$; a gate circuit 238 including an AND gate 238*a* which receives the inverted signal MEMODE and the signal $K_2$, an AND gate 238*b* which receives the signal $K_3$ and the inverted signal STMODE and an OR gate 238*c* coupoled to receive the output signals of the AND gates 238*a*, 238*b* to apply an output signal to the OR gate 222; inverters 240,242 for inverting the signals MEMODE and STMODE, respectively; a flip-flop 244 having a clock terminal $\phi$ which receives the inverted signal $K_9$ and a reset terminal R which receives the signal MEMODE for providing signals $K_{10}$ and $K_{21}$ from outputs Q and $\overline{Q}$, respectively; and NOR gates 246, 248** coupled to receive signals $K_9$, $K_{10}$ and signals $K_9$, $K_{11}$, respectively.

Figure 11:
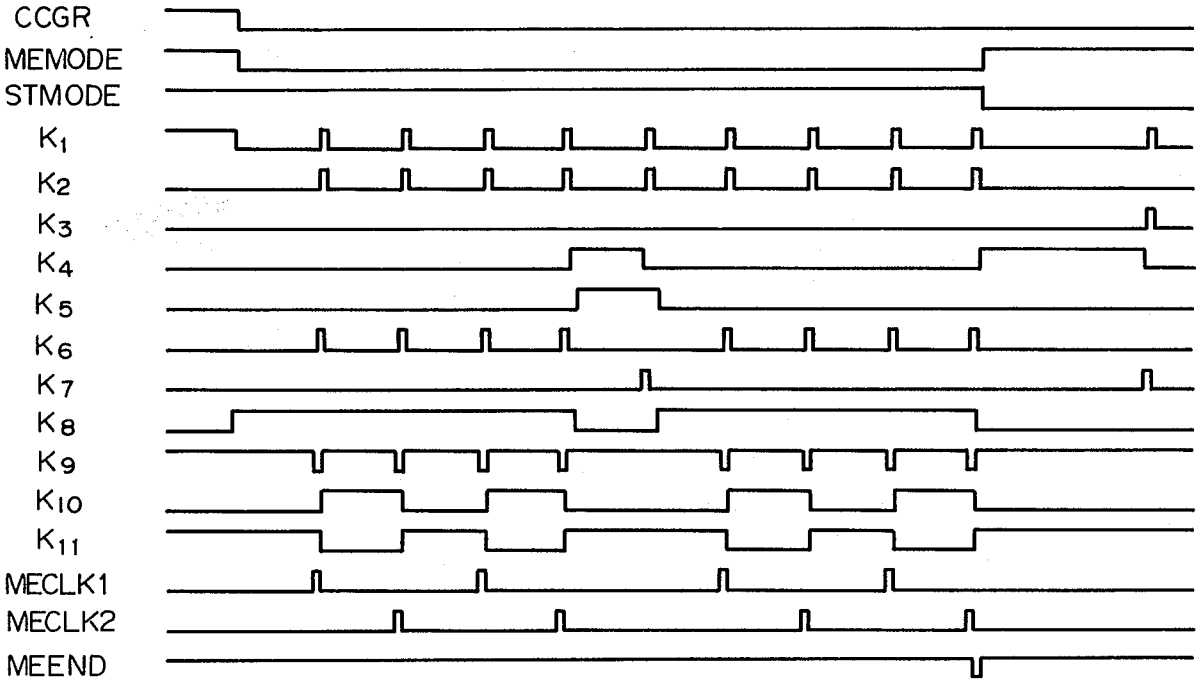
FIGS. 11 and 12 are timing charts associated with FIG. 10.
Figure 12:
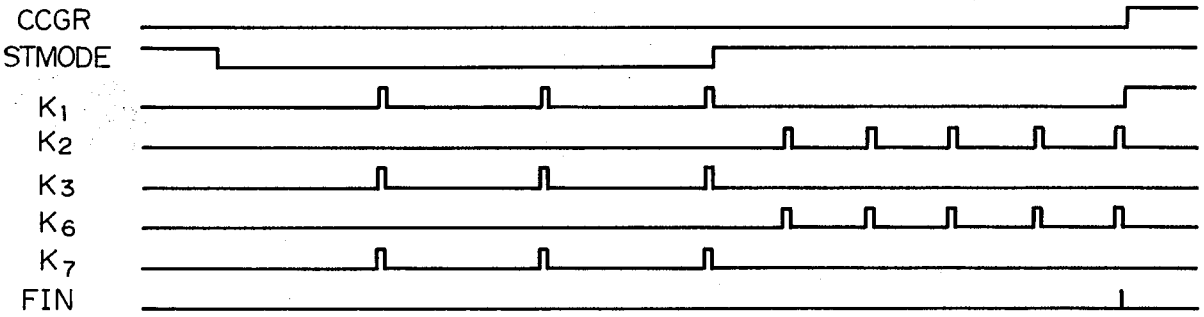

The operation of these circuits will now be described with reference to the timing charts of FIGS. 11 and 12.

When the tone generating state is established and the signal CCGR falls to the L level, the note length counter 220 is released from the reset state. Then, the note length counter 220 counts for a second and produces a pulse in the signal $K_2$ when the inverted signal STMODE is the L level. The pulse produced in the signal $K_2$ is applied to the reset terminal R of the counter 220 through the gate circuit 238 and the OR gate 222, whereby the counter 220 is reset in synchronism with the negative-going transition of the pulse. This operation of the counter 220 is repeated until the signal MEMODE becomes the H level. As a result, each of pulses is produced in the signal $K_2$ at an interval of one second.

The output signal $K_9$ of the NAND gate 236 receiving the signal $K_2$ becomes the L level for a duration of the pulse width of each pulse in the signal $K_2$, as a negative-going pulse. The flip-flop 244 has been reset by the signal MEMODE in the initial state. Terefore, the output signals $K_{10}$ and $K_{11}$ are L and H levels, respectively. In this state, when the negative-going pulse is produced in the signal $K_9$, the NOR gate 246 produces a pulse in the signal MECLK1 in response to the negative-going pulse of the signal $K_9$. This pulse of the signal MECLK1 is applied to the clock terminal $\phi$ of the counter 212 for providing a counting signal therefrom. Then, the decoder 214 applies a code signal to the variable frequency divider circuit 204 in response to the counting signal from the counter 212. The dividing ratio of the variable frequency divider circuit 204 is set to predetermined value in response to the code signal from the decoder 214, thereby supplying a frequency signal from the divider circuit 204. In the meantime, when the negative-going pulse appears in the signal $K_9$, the flip-flop 244 changes over the state in synchronism with the negative-going transition of the inverted signal $K_9$, and the output signals $K_{10}$, $K_{11}$ become H, L level, respectively. Therefore, when the next negative-going pulse appears in the signal $K_9$, the pulse is produced in the output signal MECLK2 of the NOR gate 248. This pulse of the signal MECLK2 is applied to the counter 216, and then the counter 216 provides the counting signal in response to the pulse. Further, the decoder 218 receives the counting signal for applying a code signal to the variable frequency divider circuit 206. The divider circuit 206 supplies a second frequency signal in response to the code signal.

Thus, when the negative-going pulses are produced in the signal $K_9$, the variable frequency divider circuits 204, 206 alternately provide the frequency signals to the tone generating circuit 210, thereby producing the melody tone.

At the same time, the pulses produced in the signal $K_1$ are applied to the counter 228 through the gate circuit 224. The counter 228 counts the pulses of the signal $K_6$. When the counter 228 counts fourth pulse, its output signal $K_4$ becomes the H level. Further, the flip-flop 232 changes over the state in response to the signal $K_4$ and the output signal $K_5$ attains the H level. The NOR gate 234 hold the output signal $K_4$ to the H level in response to the signal $K_5$. Therefore, the fifth pulse produced in the signal $K_2$ doesn't cause the negative-going pulse of the signal $K_9$. Thus, the pulse doesn't appear in the signals MECLK1 and MECLK2, and the tone caused by the fourth pulse of the signal $K_2$ is maintained for a double duration in comparison with the other tones.

Further, when the signal $K_5$ becomes the H level, the AND gate **226*b* of the gate circuit 226 is in an open state. As a result, the fifth pulse of the signal $K_2$ is applied to the reset terminal of the counter 228 through the gate circuit 226, thereby resetting the counter 228**. This operation is repeated until the signal MEMODE is raised to the H level.

In this embodiment, the molody composed of bars each having three quarter notes and one half note, c.g. melody of "Westminister Clock" is employed. Namely, in above-mentioned operation, the first to third pulses produced in the signals MECLK1 and MECLK2 are suitable for the three quarter notes, and the fourth pulse is suitable for the half note.

When the melody producing operation is finished by raising the signal MEMODE caused by the signal MEEND, the signal STMODE falls to the L level. Therefore, the inverted signal STMODE having the H level is applied to the tone length counter 220. Thus, the counter 220 is made to change over the state to produce in the signal $K_3$. This pulse is produced in the signal $K_3$ when the counter 220 counts for two seconds.

When the pulse is produced in the signal $K_3$, the variable frequency divider circuits 204, 206 are set to predetermined dividing ratio by receiving the pulse. Then, the divider circuits 204, 206 simultaneously supply the frequency signals to the tone generating circuit 210. The tone generating circuit 210 responds to these frequency signals by generating the strike tone.

At this time, the pulse of the signal $K_3$ is applied to the reset terminal of the counter 220 through the gate circuit 238 and OR gate 222. Thereafter, the counter 220 counts again for 2 seconds and produces a pulse in the signal $K_3$. This operation is repeated until the signal STMODE rises to the H level. The signal STMODE becomes the H level after pulses corresponding to the number of the present hour are produced in the signal $K_3$. Therefore, the inverted signal STMODE is the L level, and the counter 220 is returned into the state producing the pulse in the signal $K_2$. When the counter 228 counts five pulses of the signal $K_2$ applied through the gate circuit 224, the AND gate 230 opens, thereby rising the signal FIN to the H level. The tone operation control circuit 54 (FIG. 8) is responsive to the signal FIN and makes the signal CCGR go to the H level, whereby the tone generating operation is finished. In this case, when the five pulses are produced in the signal $K_2$, producing these pulses in the signal $K_3$ is inhibited by the signal MEMODE having the H level. Accordingly, by these pulses of the signal $K_2$, the strike tone is not produced. These pulses of the signal $K_2$ are employed for extending the final tone caused by the pulse of the signal $K_3$ for five seconds.

It should be noted that the signal NIG applied to the tone generating circuit 210 attains the H level for night silencing, thereby inhibiting the sound generating action at night.

In the present invention as described above, the time code signal is stored when an on-the-hour time is attained, and this time code signal is kept stored until the next on-the-hour time. Accordingly, even if the monitor is actuated in the period between one on-the-hour time and the next, a clock strike corresponding to the actual on-the-hour time will always be produced.

Further, the AM/PM is discriminated by the present time code and previous time code which are stored in the memory circuit, without providing the 24-hours counter.

I claim:

1. An electronic timepiece including a time tone contact for providing a start signal, a time code disk including time code patterns composed of radially extending time areas formed by dividing a surface into at least twelve areas, said time areas having electrically conductive portions and non-conductive portions which are disposed in a diametrical direction therein to provide time codes of on-the-hour times corresponding to a time indication made by time indicating hands, time tone circuit means for starting a time tone generating operation in response to said start signal and a clock strike count control circuit which receives a code signal from said time code disk as a signal for limiting the number of time tone strikes, for terminating the time tone operation when the code value and the number of time tones strikes generated coincide, comprising:

a control circuit for generating read-in signals in response to said start signal; and memory circuit means for storing said time code from said time code disk in response to said read-in signals;

wherein said time code being stored in said memory circuit means is supplied to said clock strike count control as the signal for limiting the number of time tone strikes.

2. An electronic timepiece according to claim 1, wherein said time code disk has half-hour time areas representing the on-the-half-hour times and disposed between said time areas to provide a predetermined half-hour time code, and wherein said memory circuit means comprises a discriminating circuit for discriminating on-the-hour time and on-the-half-hour time by receiving said time codes and half-hour time code and a time code memory circuit.

3. An electronic timepiece according to claim 2, wherein said read-in signals includes a discriminating signal, said discriminating circuit being responsive to said discriminating signal for storing said time codes and half-hour time code from said time code disk and for discriminating said on-the-hour time and on-the-half-hour time.

4. An electronic timepiece according to claim 3, wherein said read-in signals includes first and second read-in signals, said time code memory circuit being responsive to said first and second read-in signal for storing said code signal being stored in said discriminating circuit.

5. An electronic timepiece including an analog display for displaying time by time indicating hands, a time tone contact for providing a start signal on the hour and time tone circuit means for starting a time tone generating operation in response to said start signal, comprising:

a time code disk including time code patterns composed of radially extending time areas formed by dividing a surface into at least twelve areas, said time areas having electrically conductive portions and non-conductive portions which are disposed in a diametrical direction therein to provide time code of on the-hour time corresponding to said time indicating hands;

a control circuit responsive to said start signal to generate a first read-in signal and a second read-in signal after the predetermined time following said first read-in signal being generated;

first memory circuit means responsive to said first read-in signal for storing said time code from said time code disk;

second memory circuit means responsive to said second read-in signal for storing a stored time code in said first memory circuit means; and an AM/PM discriminating circuit including a flip-flop for providing a discriminating signal and a code detecting circuit for applying an AM/PM changing signal to said flip-flop when predetermined time codes are stored in said first and second memory circuit means, respectively.

6. An electronic timepiece according to claim 5, wherein said code detecting circuit of said AM/PM discriminating circuit provides said AM/PM changing signal when said first and second memory circuit means store said time codes indicating "1" and "12", respectively, when said stored time codes of said first and second memory circuit or said time codes indicating "12" and "1", respectively.

7. An electronic timepiece according to claim 5, further comprising a night silencing circuit for inhibiting the time tone being produced by said tone generating circuit means in response to said discriminating from said AM/PM discriminating circuit and said stored time codes of said second memory circuit means.

8. An electronic timepiece according to claim 7, wherein said night silencing circuit comprises detecting circuit means for providing a detecting signal indicating a predetermined duration in response to said stored time codes of said second memory circuit means, and circuit means for providing a silencing signal in response to said discriminating signal and said detecting signal.

9. An electronic timepiece having an oscillator circuit for providing a high-frequency signal, a frequency divider circuit for dividing said high-frequency signal, a waveform shaping circuit for shaping the waveform of an output signal of said frequency divider circuit, a motor driven by a signal from said waveform shaping circuit, a gear train driven by said motor and an analog display driven by said gear train, comprising:

a time tone contact driven by said gear train for providing a start signal on the hour and half hour;

a time code disk driven by said gear train for providing time codes indicating the on-the-hour times and half-time code indicating the on-the-half-hour time;

a time control circuit responsive to said start signal for providing a discriminating signal, a first read-in signal, a second read-in signal and tone operation start signal successively;

an on-the-hour/half-hour discriminating circuit responsive to said discriminating signal for storing said time codes and half-time code and for providing an on-the-hour/half-hour discrimination signal;

a time code memory circuit including a first memory circuit responsive to said first read-in signal for storing a stored time code from said on-the-hour/-half-hour discriminating circuit and a second memory circuit responsive to said second read-in signal for storing a stored time code from said first memory circuit;

an AM/PM discriminating circuit receiving time codes stored in said first and second memory circuit of said time code memory circuit to provide an AM/PM discriminating signal when predetermined time codes are stored in said first and second memory circuit means, respectively;

a strike count control circuit for providing a pulse signal in response to said stored time code of said second memory circuit of said time code memory circuit;

a night silencing circuit responsive to said stored time code of said second memory circuit of said time code memory circuit for detecting a predetermined duration and responsive to said AM/PM discriminating signal for providing a silencing signal during said predetermined duration; and time tone circuit means responsive to said tone operation start signal for staring a tone operation and responsive to said pulse signal from said strike count control circuit for terminating the tone operation.

* * * * *